US011913749B2

(12) United States Patent
Yao et al.

(10) Patent No.: US 11,913,749 B2
(45) Date of Patent: Feb. 27, 2024

(54) MAGAZINE LOADER

(71) Applicant: Shenzhen Yiluo Technology Co., Ltd., Guangdong (CN)

(72) Inventors: Nianzhong Yao, Guangdong (CN); MingYang She, Guangdong (CN)

( * ) Notice: Subject to any disclaimer, the term of this patent is extended or adjusted under 35 U.S.C. 154(b) by 1 day.

(21) Appl. No.: 17/868,288

(22) Filed: Jul. 19, 2022

(65) Prior Publication Data

US 2024/0027153 A1 Jan. 25, 2024

(51) Int. Cl.
*F41A 9/83* (2006.01)

(52) U.S. Cl.
CPC ..... *F41A 9/83* (2013.01)

(58) Field of Classification Search
CPC ..... F41A 9/82; F41A 9/83; F41A 9/84
See application file for complete search history.

(56) References Cited

U.S. PATENT DOCUMENTS 5,249,386 A * 10/1993 Switzer ..... F41A 9/83 42/87
5,355,606 A * 10/1994 Origoni ..... F41A 9/83 42/87
11,029,108 B1 * 6/2021 Tal ..... F41A 9/84
2004/0159035 A1 * 8/2004 Newman ..... F41A 9/83 42/87
2007/0107291 A1 * 5/2007 Tal ..... F41A 9/83 42/87
2013/0232843 A1 * 9/2013 Bajuelo ..... F41A 9/83 42/87
2021/0164746 A1 * 6/2021 Chen ..... F41A 9/83
2023/0175798 A1 * 6/2023 Halbeisen ..... F41A 9/83 42/87

FOREIGN PATENT DOCUMENTS

AT 9463 U1 * 10/2007
AT 522962 A4 * 4/2021 ..... F41A 9/83
GB 555367 A * 8/1943

* cited by examiner

*Primary Examiner* — Gabriel J. Klein

(57) ABSTRACT

A magazine loader includes a clamping frame; a clamping groove used for placing a cartridge clip is formed in a front side of the clamping frame; a clamping groove penetrates through an upper end face and a lower end face of the clamping frame; a limiting structure is arranged in a lower port of the clamping groove; a bullet pressing tongue plate is arranged in an upper port of the clamping groove; a grip and a linkage mechanism are arranged on a rear side of the clamping frame; one end of the grip is hinged to the clamping frame; the grip is connected to the bullet pressing tongue plate through the linkage mechanism, so that the bullet pressing tongue plate can move up and down in the upper port of the clamping groove.

7 Claims, 3 Drawing Sheets

MAGAZINE LOADER

TECHNICAL FIELD

The present disclosure relates to the technical field of firearm equipment, and in particular, to a magazine loader.

BACKGROUND

Presently, bullet pressers widely used in the field of firearms are typically in single-bullet direct pressing mode. When such bullet pressers are operated, the bottom of a magazine is pressed against a plane, a pressing head is used to press against a bullet, and the pressing head is held with a single hand, so that the user's wrist is perpendicular to the magazine. Finally, the bullet is pressed down into the magazine, and the abovementioned actions are repeated to press bullets to fill up the magazine. This type of operation mode puts great pressure on user's wrist, and the bullet pressing springs used in large-capacity cartridge clips magazines requires high strength. The wrist of an operator can be easily tired out by pressing the bullets frequently, potentially causing injury. The bullet loading efficiency is also very low. Therefore, the prior art needs to be improved and developed.

SUMMARY

An objective of the present disclosure is to provide a magazine loader, with an efficient structure, to reduce the force required for pressing bullets, and to achieve convenience in operation and high bullet loading efficiency, in view of the defects and disadvantages in the prior art.

To achieve the above objective, the present disclosure adopts the following technical solution:

A magazine loader described in the present disclosure includes a clamping frame. A clamping groove used for placing a magazine is formed in a front side of the clamping frame. The clamping groove penetrates through an upper end face and a lower end face of the clamping frame. A limiting structure is arranged in a lower port of the clamping groove. A bullet pressing tongue plate is arranged in an upper port of the clamping groove. A grip and a linkage mechanism are arranged on a rear side of the clamping frame. One end of the grip is hinged to the clamping frame. The grip is connected to the bullet pressing tongue plate through the linkage mechanism, so that the bullet pressing tongue plate can move up and down in the upper port of the clamping groove.

According to the above solution, the linkage mechanism includes a bullet pressing connecting rod and a linkage connecting rod. The bullet pressing connecting rod is in fit connection with the clamping frame, so that the bullet pressing connecting rod can move up and down along the clamping frame. An upper end of the bullet pressing connecting rod is in fit connection with the bullet pressing tongue plate. The linkage connecting rod is arranged between the clamping frame and the grip. One end of the linkage connecting rod is hinged to a lower end of the bullet pressing connecting rod, and the other end of the linkage connecting rod is hinged to the grip.

According to the above solution, a bending part arranged in an L shape with the bullet pressing connecting rod is arranged at the upper end thereof. An upper end of the bullet pressing tongue plate is hinged to the bending part. A baffle plate is arranged on a front side of an upper end of the clamping groove. Two ends of the baffle plate are fixedly connected to the clamping frame respectively. The bullet pressing tongue plate is movably arranged in an upper port of the clamping groove between the baffle plate and the clamping frame in a penetrating mode.

According to the above solution, side protective plates are arranged on both sides of the clamping groove. A rear end of each side protective plate is fixedly connected to the clamping frame. A positioning pressing plate is arranged between the two side protective plates. An upper end of the positioning pressing plate is connected to each of the two side protective plates through hinge shafts respectively.

According to the above solution, arc-shaped baffle plates are arranged on two sides of the positioning pressing plate. A bearing surface with radian is formed between each of the two arc-shaped baffle plates and the positioning pressing plate. An inner central axis of the bearing surface is located in the clamping groove.

According to the above solution, the limiting structure includes a bearing plate. The bearing plate is arranged at a lower port of the clamping groove in the transverse direction. The bearing plate is in fit connection with the clamping frame.

The present disclosure has the beneficial effects that: the present disclosure is reasonable in structure. The bearing plate is movably connected to the clamping frame. The magazine loader can be expanded to be compatible with magazines with different specifications. The magazine is inserted into the clamping groove. The magazine can be arranged centrally by the positioning pressing plate. An operator then holds the clamping frame to drive the bullet pressing tongue plate to be pressed down through the grip and the linkage connecting rod, so that the bullet is pressed into the magazine, and the bullet loading efficiency can be effectively improved.

1, clamping frame; 2, bullet pressing tongue plate; 3, grip; 11, clamping groove; 12, side protective plate; 13, positioning pressing plate; 14, arc-shaped baffle plate; 15, bearing plate; 21, bullet pressing connecting rod; 22, bending part; 23, baffle plate; and 31, linkage connecting rod.

DETAILED DESCRIPTION OF THE EMBODIMENTS

The technical solution of the present disclosure is described below in combination with accompanying drawings and embodiments.

Figure 1:
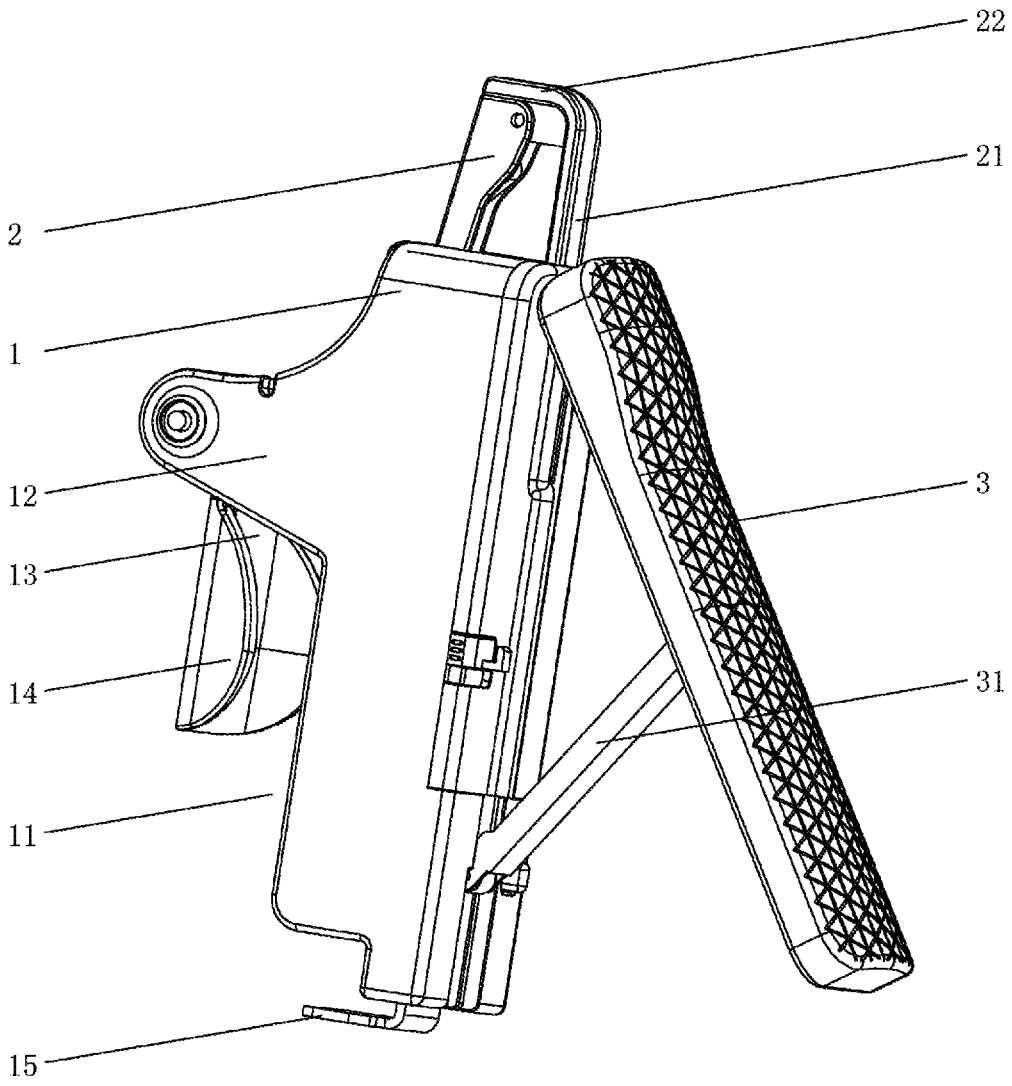
FIG. 1 is schematic diagram of an overall structure of the present disclosure.
Figure 2:
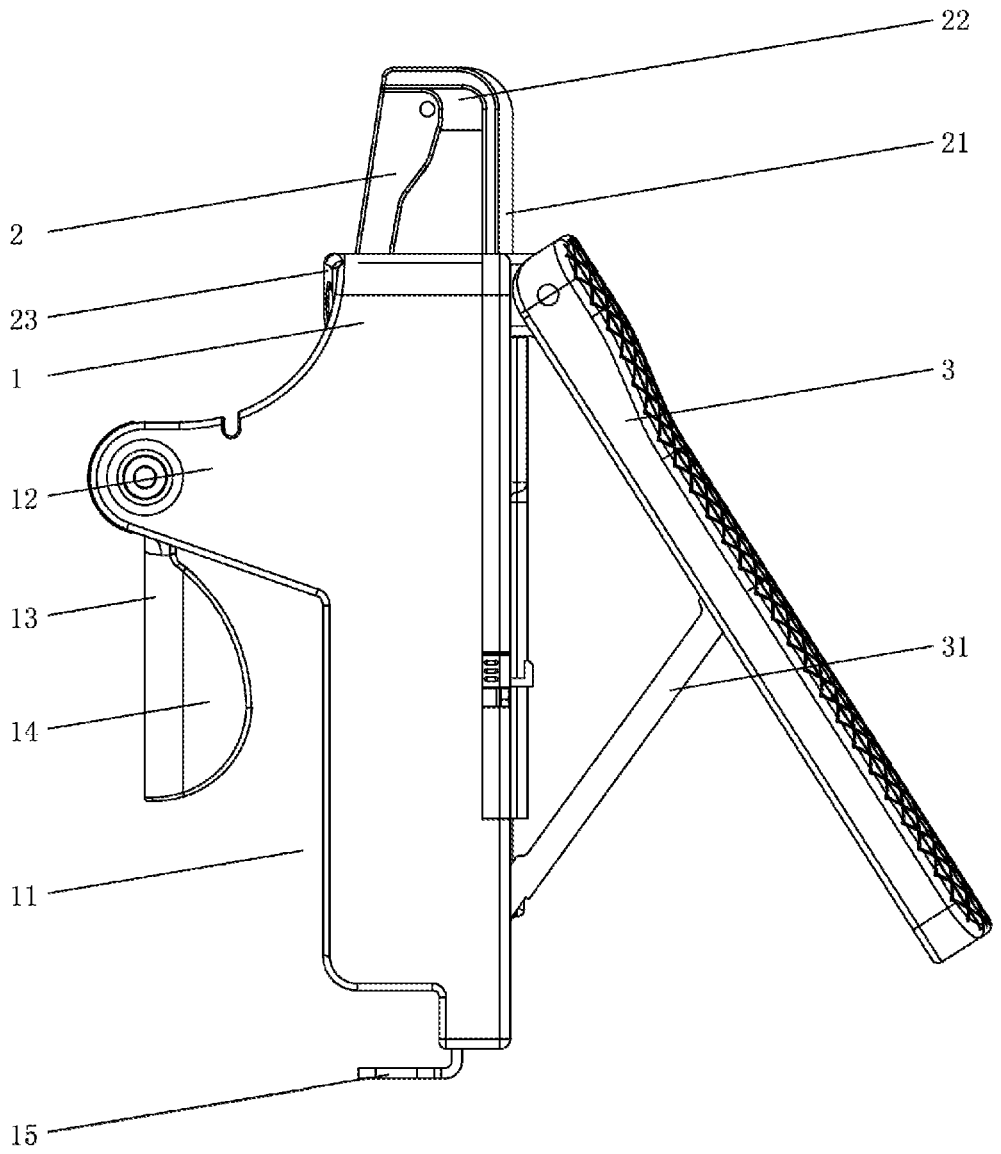
FIG. 2 is a schematic diagram of a side-view structure of the present disclosure.
Figure 3:
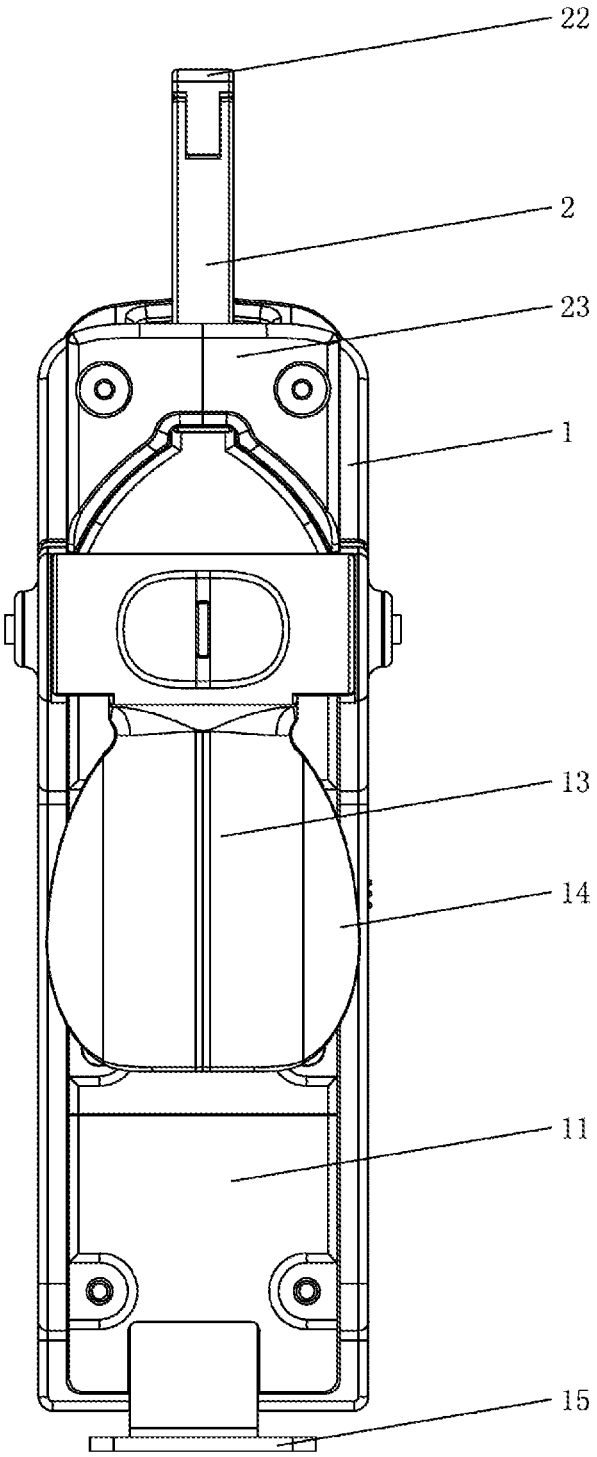
FIG. 3 is a schematic diagram of a front-view structure of the present disclosure.

As shown in FIG. 1 to FIG. 3, a magazine loader described in the present disclosure includes a clamping frame 1. A clamping groove 11 used for placing a magazine is formed in a front side of the clamping frame 1. The clamping groove 11 penetrates through an upper end face and a lower end face of the clamping frame 1. A limiting structure is arranged in a lower port of the clamping groove 11. A bullet pressing tongue plate 2 is arranged in an upper port of the clamping groove 11. A grip 3 and a linkage mechanism are arranged on a rear side of the clamping frame 1. One end of the grip 3 is hinged to the clamping frame 1. The grip 3 is connected to the bullet pressing tongue plate 2 through the linkage mechanism, so that the bullet pressing tongue plate 2 can move up and down in the upper port of the clamping groove 11. The upper end of the grip 3 is hinged to the clamping frame 1. Based on a lever principle, a lower end of the grip 3 can be driven to rotate relative to the clamping frame 1 through a small force, and then the moving direction of the grip 3 is changed through the linkage mechanism, so that the grip 3 can drive the bullet pressing tongue plate 2 to move up and down in the upper port of the clamping groove 11. The magazine is fixed to the clamping frame 1 after being mounted in the clamping groove 11. A spring in the magazine retracts by pressing down the bullet pressing tongue plate 2. At this time, a bullet can be loaded into the magazine easily. The bullet pressing tongue plate 2 is reset after the grip 3 is released. The bullet pressing tongue plate 2 collides with the uppermost bullet when being pressed down again. The bullet pressing tongue plate 2 drives the spring in the magazine to be compressed again, so as to form a cavity at a loading port of the magazine to facilitate the loading of the bullet. The bullets can be pressed to fill up the magazine by repeating the abovementioned process, the force required by an operator during bullet loading can be reduced, and the bullet loading efficiency can be improved.

The linkage mechanism includes a bullet pressing connecting rod 21 and a linkage connecting rod 31. The bullet pressing connecting rod 21 is in fit connection with the clamping frame 1, so that the bullet pressing connecting rod 21 can move up and down along the clamping frame 1. An upper end of the bullet pressing connecting rod 21 is in fit connection with the bullet pressing tongue plate 2. The linkage connecting rod 31 is arranged between the clamping frame 1 and the grip 3. One end of the linkage connecting rod 31 is hinged to a lower end of the bullet pressing connecting rod 21, and the other end of the linkage connecting rod 31 is hinged to the grip 3. The bullet pressing connecting rod 21 can move up and down along the clamping frame 1. A chute adapted to the bullet pressing connecting rod 21 may be formed in the clamping groove 1, or a corresponding guide structure is arranged in the clamping groove 11 to limit the stroke action of the bullet pressing connecting rod 21. The up-down movement of the bullet pressing connecting rod 21 can drive the bullet pressing tongue plate 2, so that the rotation of the grip 3 is converted into the action of compressing a magazine spring of the bullet pressing tongue plate 2. Further, two ends of the linkage connecting rod 31 are respectively hinged to the grip 3 and the bullet pressing connecting rod 21. The linkage connecting rod 31 amplifies the acting force generated by the grip 3 through a lever principle, and the operator can overcome the resistance of the spring in the magazine through a very small force.

A bending part 22 arranged in an L shape with the bullet pressing connecting rod 21 is arranged at the upper end thereof. An upper end of the bullet pressing tongue plate 2 is hinged to the bending part 22. A baffle plate 23 is arranged on a front side of an upper end of the clamping groove 11. Two ends of the baffle plate 23 are fixedly connected to the clamping frame 1 respectively. The bullet pressing tongue plate 2 is movably arranged in an upper port of the clamping groove 11 between the baffle plate 23 and the clamping frame 1 in a penetrating mode. The bending part 22 is used for synchronously connecting the bullet pressing connecting rod 21 and the bullet pressing tongue plate 2. The bullet pressing tongue plate 2 is connected to the bending part 22 in a hinged mode. A port for the bullet pressing tongue plate 2 to move up and down is formed in the baffle plate 23 at the upper end of the clamping groove 11. The bullet pressing connecting rod 21 has a degree of freedom of moving backward and forward in a stressed state, so that a bullet pressing action is more smooth and stable, and the bullet is prevented from being blocked.

Side protective plates 12 are arranged on both sides of the clamping groove 11. A rear end of each side protective plate 12 is fixedly connected to the clamping frame 1. A positioning pressing plate 13 is arranged between the two side protective plates 12. An upper end of the positioning pressing plate 13 is connected to each of the two side protective plates 12 through hinge shafts respectively. The positioning pressing plate 13 is arranged at a front side of the clamping frame 1 through the side protective plates 12. The positioning pressing plate 13 can perform an action of overturning up and down relative to the clamping frame 1 through the side protective plates 12. When the positioning pressing plate 13 is overturned upwards, the inserting of the magazine into the clamping groove 11 can be facilitated. A front side surface of the magazine can be fixed when the positioning pressing plate 13 is pressed down, while a rear side and the two sides of the magazine are all limited by the clamping frame 1, so that the magazine is relatively fixedly arranged in the clamping groove 11. Particularly, the operator can adopt a posture of holding the clamping frame 1 to respectively apply a force on the positioning pressing plate 13 and the grip 3 during loading the bullets, which not only ensures the stability of the magazine in the clamping groove 11, but also facilitates the operation.

Arc-shaped baffle plates 14 are arranged on two sides of the positioning pressing plate 13. A bearing surface with radian is formed between each of the two arc-shaped baffle plates 14 and the positioning pressing plate 13. An inner central axis of the bearing surface is located in the clamping groove 11. The arc-shaped baffle plates 14 and the positioning pressing plate 13 are of an integrated structure, so as to facilitate machining. The magazine can be arranged centrally in the clamping groove 11 through the bearing surface formed by the arc-shaped baffle plates 14 and the positioning pressing plate 13.

The limiting structure includes a bearing plate 15. The bearing plate 15 is arranged at a lower port of the clamping groove 11 in the transverse direction. The bearing plate 15 is in fit connection with the clamping frame 1. The bearing plate 15 can be assembled at the lower end of the clamping frame 1 through a chute structure. The bearing plate 15 can slide back and forth in the transverse direction, so as to adapt to magazines with different specifications.

The above description is only a preferred implementation mode of the present disclosure, so any equivalent changes or modifications made in accordance with the structures, features, and principles described in the scope of the patent application of the present disclosure are included in the scope of the patent application of the present disclosure.

The invention claimed is:

1. A magazine loader, comprising a clamping frame (1), wherein a clamping groove (11) for placing a magazine is formed in a front side of the clamping frame (1); wherein the clamping groove (11) penetrates through an upper end face and a lower end face of the clamping frame (1); wherein a limiting structure is arranged in a lower port of the clamping groove (11); wherein a bullet pressing tongue plate (2) is arranged in an upper port of the clamping groove (11); wherein a grip (3) and a linkage mechanism are arranged on a rear side of the clamping frame (1); wherein one end of the grip (3) is hinged to the clamping frame (1); and wherein the grip (3) is connected to the bullet pressing tongue plate (2)

through the linkage mechanism, so that the bullet pressing tongue plate (2) is capable of moving vertically in the upper port of the clamping groove (11);

wherein the linkage mechanism further comprising a bullet pressing connecting rod (21) and a linkage connecting rod (31); wherein the bullet pressing connecting rod (21) is in fit connection with the clamping frame (1), so that the bullet pressing connecting rod (21) is capable of moving vertically along the clamping frame (1); wherein an upper end of the bullet pressing connecting rod (21) is in fit connection with the bullet pressing tongue plate (2); wherein the linkage connecting rod (31) is arranged between the clamping frame (1) and the grip (3); and wherein one end of the linkage connecting rod (31) is hinged to a lower end of the bullet pressing connecting rod (21), and wherein another end of the linkage connecting rod (31) is hinged to the grip (3).

2. The magazine loader according to claim 1, wherein a bending part (22) is arranged at an upper end of the bullet pressing connecting rod (21) and forms a L-shape with the bullet pressing connecting rod; wherein the upper end of the bullet pressing tongue plate (2) is hinged to the bending part (22); wherein a baffle plate (23) is arranged on a front side of an upper end of the clamping groove (11); wherein two ends of the baffle plate (23) are fixedly connected to the clamping frame (1); and wherein the bullet pressing tongue plate (2) is movably arranged in an upper port of the clamping groove (11) between the baffle plate (23) and the clamping frame (1).

3. The magazine loader according to claim 2, wherein two side protective plates (12) are arranged on two sides of the clamping groove (11) respectively; wherein a rear end of each side protective plate (12) is fixedly connected to the clamping frame (1); wherein a positioning pressing plate (13) is arranged between the two side protective plates (12); and wherein an upper end of the positioning pressing plate (13) is connected to each of the two side protective plates (12) through hinge shafts.

4. The magazine loader according to claim 1, wherein two side protective plates (12) are arranged on two sides of the clamping groove (11) respectively; wherein a rear end of each side protective plate (12) is fixedly connected to the clamping frame (1); wherein a positioning pressing plate (13) is arranged between the two side protective plates (12); and wherein an upper end of the positioning pressing plate (13) is connected to each of the two side protective plates (12) through hinge shafts.

5. The magazine loader according to claim 1, wherein the limiting structure further comprising a bearing plate (15); wherein the bearing plate (15) is arranged at a lower port of the clamping groove (11) in the transverse direction; and wherein the bearing plate (15) is in fit connection with the clamping frame (1).

6. The magazine loader according to claim 1, wherein two side protective plates (12) are arranged on two sides of the clamping groove (11) respectively; wherein a rear end of each side protective plate (12) is fixedly connected to the clamping frame (1); wherein a positioning pressing plate (13) is arranged between the two side protective plates (12); and wherein an upper end of the positioning pressing plate (13) is connected to each of the two side protective plates (12) through hinge shafts.

7. A magazine loader, comprising a clamping frame (1), wherein a clamping groove (11) for placing a magazine is formed in a front side of the clamping frame (1); wherein the clamping groove (11) penetrates through an upper end face and a lower end face of the clamping frame (1); wherein a limiting structure is arranged in a lower port of the clamping groove (11); wherein a bullet pressing tongue plate (2) is arranged in an upper port of the clamping groove (11); wherein a grip (3) and a linkage mechanism are arranged on a rear side of the clamping frame (1); wherein one end of the grip (3) is hinged to the clamping frame (1); and wherein the grip (3) is connected to the bullet pressing tongue plate (2) through the linkage mechanism, so that the bullet pressing tongue plate (2) is capable of moving vertically in the upper port of the clamping groove (11);

wherein two side protective plates (12) are arranged on two sides of the clamping groove (11) respectively; wherein a rear end of each side protective plate (12) is fixedly connected to the clamping frame (1); wherein a positioning pressing plate (13) is arranged between the two side protective plates (12); and wherein an upper end of the positioning pressing plate (13) is connected to each of the two side protective plates (12) through hinge shafts;

wherein arc-shaped baffle plates (14) are arranged on two sides of the positioning pressing plate (13); wherein a bearing surface with radian is formed between each of the two arc-shaped baffle plates (14) and the positioning pressing plate (13); and wherein an inner central axis of the bearing surface is located in the clamping groove (11).

* * * * *